US008168013B2

(12) United States Patent
Shibata et al.

(10) Patent No.: US 8,168,013 B2
(45) Date of Patent: May 1, 2012

(54) AL-MG-SI ALUMINUM ALLOY EXTRUDED PRODUCT EXHIBITING EXCELLENT FATIGUE STRENGTH AND IMPACT FRACTURE RESISTANCE

(75) Inventors: Karin Shibata, Oyabe (JP); Tomoo Yoshida, Namerikawa (JP); Hiroshi Tabuchi, Tsukuba (JP); Hidetoshi Takagi, Toyama (JP)

(73) Assignees: Aisin Keikinzoku Co., Ltd. (JP); Sumitomo Chemical Company, Limited (JP)

( * ) Notice: Subject to any disclaimer, the term of this patent is extended or adjusted under 35 U.S.C. 154(b) by 0 days.

(21) Appl. No.: 13/160,609

(22) Filed: Jun. 15, 2011

(65) Prior Publication Data

US 2011/0240178 A1 Oct. 6, 2011

Related U.S. Application Data

(62) Division of application No. 12/543,545, filed on Aug. 19, 2009, now abandoned.

(30) Foreign Application Priority Data

Aug. 21, 2008 (JP) ..... 2008-213384
Jun. 5, 2009 (JP) ..... 2009-135607

(51) Int. Cl.
*C22F 1/05* (2006.01)

(52) U.S. Cl. ..... 148/550; 148/690

(58) Field of Classification Search ..... 148/550, 148/690
See application file for complete search history.

(56) References Cited

U.S. PATENT DOCUMENTS 6,258,465 B1 7/2001 Oka et al.

FOREIGN PATENT DOCUMENTS

| | | |
|---|---|---|
| EP | 1 041 165 | 10/2000 |
| JP | 2000-239810 | 9/2000 |
| JP | 2001-316750 | 11/2001 |
| JP | 2005-082816 | 3/2005 |

*Primary Examiner* — Roy King
*Assistant Examiner* — Janelle Morillo
(74) *Attorney, Agent, or Firm* — Harness, Dickey & Pierce, P.L.C.

(57) ABSTRACT

A method includes: preparing a molten aluminum alloy consisting of 0.3-0.8 mass % Mg, 0.5-1.2 mass % Si, 0.3 mass % or more excess Si relative to the $Mg_2Si$ stoichiometric composition, 0.05-0.4 mass % Cu, 0.2-0.4 mass % Mn, 0.1-0.3 mass % Cr, 0.2 mass % or less Fe, 0.2 mass % or less Zr, and 0.005-0.1 mass % Ti, with the balance being aluminum and unavoidable impurities; casting the alloy into a billet at a speed of 80 mm/min or more and a cooling rate of 15° C./sec or more; extruding the billet into an extruded product; water cooling the product immediately after extrusion at 500° C./min or more; and artificially aging the product, thereby yielding an extruded product with fatigue strength of 140 MPa or more, fatigue ratio of 0.45 or more, an interval between striations on a fatigue fracture surface of 5.0 μm or less, and a maximum length of Al—Fe—Si crystallized products of 10 μm or less.

6 Claims, 8 Drawing Sheets

| | Alloy No | Chemical component (mass%) | | | | | | | | | | Casting speed (mm/min) |
|---|---|---|---|---|---|---|---|---|---|---|---|---|
| | | Si | Fe | Cu | Mn | Mg | Cr | Zr | Ti | $Mg_2Si$ | exSi | |
| Example | 1 | 0.65 | 0.18 | 0.05 | 0.32 | 0.40 | 0.20 | 0.00 | 0.01 | 0.63 | 0.37 | 180 |
| | 2 | 0.66 | 0.18 | 0.30 | 0.31 | 0.39 | 0.20 | 0.00 | 0.01 | 0.62 | 0.39 | 180 |
| | 3 | 0.65 | 0.03 | 0.05 | 0.32 | 0.40 | 0.20 | 0.00 | 0.01 | 0.63 | 0.41 | 180 |
| | 4 | 0.66 | 0.18 | 0.32 | 0.32 | 0.40 | 0.20 | 0.00 | 0.01 | 0.63 | 0.38 | 80 |
| | 5 | 0.67 | 0.01 | 0.32 | 0.33 | 0.42 | 0.20 | 0.00 | 0.01 | 0.66 | 0.42 | 80 |
| | 2-1 | 1.04 | 0.18 | 0.30 | 0.30 | 0.59 | 0.20 | 0.00 | 0.01 | 0.93 | 0.65 | 80 |
| | 2-2 | 1.06 | 0.06 | 0.30 | 0.30 | 0.62 | 0.19 | 0.00 | 0.01 | 0.98 | 0.69 | 80 |
| Comparative Example | 6 | 0.43 | 0.01 | 0.00 | 0.30 | 0.49 | 0.00 | 0.10 | 0.02 | 0.77 | 0.14 | 180 |
| | 7 | 0.44 | 0.18 | 0.00 | 0.30 | 0.48 | 0.00 | 0.10 | 0.02 | 0.76 | 0.11 | 180 |
| | 8 | 0.44 | 0.18 | 0.00 | 0.30 | 0.48 | 0.00 | 0.00 | 0.02 | 0.76 | 0.11 | 180 |
| | 9 | 0.43 | 0.18 | 0.00 | 0.00 | 0.49 | 0.00 | 0.00 | 0.02 | 0.77 | 0.10 | 180 |
| | 10 | 0.71 | 0.33 | 0.21 | 0.24 | 0.97 | 0.18 | 0.00 | 0.03 | 1.53 | 0.06 | 180 |
| | 11 | 0.43 | 0.18 | 0.00 | 0.00 | 0.49 | 0.00 | 0.00 | 0.01 | 0.77 | 0.10 | 90 |
| | 12 | 0.43 | 0.18 | 0.00 | 0.00 | 0.49 | 0.00 | 0.00 | 0.01 | 0.77 | 0.10 | 65 |
| | 13 | 0.71 | 0.34 | 0.22 | 0.25 | 0.94 | 0.18 | 0.00 | 0.03 | 1.48 | 0.08 | 65 |

FIG. 1

| | Alloy No. | Chemical component (mass%) | | | | | | | | | | Casting speed (mm/min) |
|---|---|---|---|---|---|---|---|---|---|---|---|---|
| | | Si | Fe | Cu | Mn | Mg | Cr | Zr | Ti | $Mg_2Si$ | exSi | |
| Example | 1 | 0.65 | 0.18 | 0.05 | 0.32 | 0.40 | 0.20 | 0.00 | 0.01 | 0.63 | 0.37 | 180 |
| | 2 | 0.66 | 0.18 | 0.30 | 0.31 | 0.39 | 0.20 | 0.00 | 0.01 | 0.62 | 0.39 | 180 |
| | 3 | 0.65 | 0.03 | 0.05 | 0.32 | 0.40 | 0.20 | 0.00 | 0.01 | 0.63 | 0.41 | 180 |
| | 4 | 0.66 | 0.18 | 0.32 | 0.32 | 0.40 | 0.20 | 0.00 | 0.01 | 0.63 | 0.38 | 80 |
| | 5 | 0.67 | 0.01 | 0.32 | 0.33 | 0.42 | 0.20 | 0.00 | 0.01 | 0.66 | 0.42 | 80 |
| | 2-1 | 1.04 | 0.18 | 0.30 | 0.30 | 0.59 | 0.20 | 0.00 | 0.01 | 0.93 | 0.65 | 80 |
| | 2-2 | 1.06 | 0.06 | 0.30 | 0.30 | 0.62 | 0.19 | 0.00 | 0.01 | 0.98 | 0.69 | 80 |
| Comparative Example | 6 | 0.43 | 0.01 | 0.00 | 0.30 | 0.49 | 0.00 | 0.10 | 0.02 | 0.77 | 0.14 | 180 |
| | 7 | 0.44 | 0.18 | 0.00 | 0.30 | 0.48 | 0.00 | 0.10 | 0.02 | 0.76 | 0.11 | 180 |
| | 8 | 0.44 | 0.18 | 0.00 | 0.30 | 0.48 | 0.00 | 0.00 | 0.02 | 0.76 | 0.11 | 180 |
| | 9 | 0.43 | 0.18 | 0.00 | 0.00 | 0.49 | 0.00 | 0.00 | 0.02 | 0.77 | 0.10 | 180 |
| | 10 | 0.71 | 0.33 | 0.21 | 0.24 | 0.97 | 0.18 | 0.00 | 0.03 | 1.53 | 0.06 | 180 |
| | 11 | 0.43 | 0.18 | 0.00 | 0.00 | 0.49 | 0.00 | 0.00 | 0.01 | 0.77 | 0.10 | 90 |
| | 12 | 0.43 | 0.18 | 0.00 | 0.00 | 0.49 | 0.00 | 0.00 | 0.01 | 0.77 | 0.10 | 65 |
| | 13 | 0.71 | 0.34 | 0.22 | 0.25 | 0.94 | 0.18 | 0.00 | 0.03 | 1.48 | 0.08 | 65 |

FIG. 2

| Alloy No. | | Fatigue strength | | Fatigue ratio | | Impact value | | Tensile strength | Proof stress | Elongation | Crystal grain size | | Striation | | Length of crystallized product | | Evaluation |
|---|---|---|---|---|---|---|---|---|---|---|---|---|---|---|---|---|---|
| Target value | | 140 MPa or more | | 0.45 or more | | 60 J/cm$^2$ or more | | 200 MPa or more | 180 MPa or more | 13% or more | 50 μm or less | | 5.0 μm or less | | 10.0 μm or less | | |
| Example | 1 | 145 | Good | 0.52 | Good | 82.5 | Good | 279 | 246 | 20.0 | 20 | Good | 1.0 | Good | 1.6 | Good | Good |
| | 2 | 159 | Good | 0.49 | Good | 97.8 | Good | 326 | 294 | 19.6 | 20 | Good | 0.5 | Good | 1.5 | Good | Good |
| | 3 | 149 | Good | 0.53 | Good | 94.8 | Good | 282 | 252 | 21.1 | 20 | Good | 0.9 | Good | 1.2 | Good | Good |
| | 4 | 146 | Good | 0.51 | Good | 93.5 | Good | 284 | 246 | 19.3 | 40 | Good | 1.1 | Good | 3.0 | Good | Good |
| | 5 | 156 | Good | 0.51 | Good | 117.5 | Good | 305 | 270 | 21.2 | 40 | Good | 0.8 | Good | 2.0 | Good | Good |
| | 2-1 | 184 | Good | 0.46 | Good | 70.8 | Good | 403 | 381 | 19.0 | 20 | Good | 0.4 | Good | 2.8 | Good | Good |
| | 2-2 | 183 | Good | 0.46 | Good | 85.3 | Good | 402 | 379 | 19.8 | 20 | Good | 0.4 | Good | 2.4 | Good | Good |
| Comparative Example | 6 | 110 | Bad | 0.45 | Good | 92.7 | Good | 244 | 218 | 23.5 | 40 | Good | 6.0 | Bad | 1.2 | Good | Bad |
| | 7 | 129 | Bad | 0.50 | Good | 106.5 | Good | 259 | 229 | 21.6 | 20 | Good | 4.7 | Good | 1.9 | Good | Bad |
| | 8 | 104 | Bad | 0.48 | Good | 76.5 | Good | 216 | 194 | 22.1 | 20 | Good | 7.0 | Bad | 1.8 | Good | Bad |
| | 9 | 104 | Bad | 0.46 | Good | 46.7 | Bad | 228 | 203 | 22.4 | 200 | Bad | 8.5 | Bad | 1.9 | Good | Bad |
| | 10 | 165 | Good | 0.45 | Good | 64.4 | Good | 370 | 347 | 16.1 | 40 | Good | 0.7 | Good | 2.0 | Good | Bad |
| | 11 | 99 | Bad | 0.44 | Bad | 42.5 | Bad | 226 | 201 | 21.3 | 400 | Bad | 9.0 | Bad | 6.0 | Good | Bad |
| | 12 | 89 | Bad | 0.40 | Bad | 39.7 | Bad | 220 | 193 | 20.8 | 800 | Bad | 10.5 | Bad | 10.0 | Bad | Bad |
| | 13 | 150 | Good | 0.40 | Bad | 53.0 | Bad | 374 | 349 | 16.1 | 40 | Good | 2.1 | Good | 12.0 | Bad | Bad |

FIG. 3

| Alloy No. | | Tensile strength (MPa) | | Proof stress (MPa) | | Elongation (%) | | Surface properties | Bendability | | n-value (work hardening exponent) | | r-value (Lankford value) | | Extrudability | | Evaluation |
|---|---|---|---|---|---|---|---|---|---|---|---|---|---|---|---|---|---|
| Target value | | - | | - | | - | | No orange peeling | No cracks at 60% or more | | 0.23 or more | | 0.7 or more | | 0.9 or less | | |
| Example | 1 | 180 | | 70 | | 33.0 | | Good | No cracks | Good | 0.23 | Good | 0.72 | Good | 0.84 | Good | Good |
| | 2 | 190 | | 75 | | 34.0 | | Good | No cracks | Good | 0.24 | Good | 0.75 | Good | 0.84 | Good | Good |
| | 3 | 141 | | 50 | | 36.9 | | Good | No cracks | Good | 0.27 | Good | 0.70 | Good | 0.82 | Good | Good |
| | 4 | 193 | | 79 | | 33.0 | | Good | No cracks | Good | 0.24 | Good | 0.72 | Good | 0.86 | Good | Good |
| | 5 | 143 | | 51 | | 36.7 | | Good | No cracks | Good | 0.29 | Good | 0.70 | Good | 0.82 | Good | Good |
| | 2-1 | 265 | | 121 | | 28.1 | | Good | No cracks | Good | 0.25 | Good | 0.72 | Good | 0.90 | Good | Good |
| | 2-2 | 252 | | 109 | | 29.7 | | Good | No cracks | Good | 0.29 | Good | 0.74 | Good | 0.89 | Good | Good |
| Comparative Example | 6 | 177 | | 77 | | 31.2 | | Good | No cracks | Good | 0.26 | Good | 0.61 | Bad | 0.81 | Good | Bad |
| | 7 | 181 | | 87 | | 31.5 | | Good | No cracks | Good | 0.26 | Good | 0.60 | Bad | 0.81 | Good | Bad |
| | 8 | 165 | | 75 | | 30.0 | | Good | No cracks | Good | 0.26 | Good | 0.61 | Bad | 0.81 | Good | Bad |
| | 9 | 172 | | 85 | | 30.0 | | Bad | No cracks | Good | 0.25 | Good | 0.62 | Bad | 0.81 | Good | Bad |
| | 10 | 229 | | 93 | | 27.2 | | Good | Cracks occurred | Bad | 0.22 | Bad | 0.65 | Bad | 1.00 | Bad | Bad |
| | 11 | 171 | | 83 | | 31.3 | | Bad | No cracks | Good | 0.25 | Good | 0.61 | Bad | 0.81 | Good | Bad |
| | 12 | 168 | | 82 | | 31.2 | | Bad | No cracks | Good | 0.25 | Good | 0.62 | Bad | 0.81 | Good | Bad |
| | 13 | 231 | | 94 | | 27.0 | | Good | Cracks occurred | Bad | 0.22 | Bad | 0.65 | Bad | 1.00 | Bad | Bad |

(LENGTH OF CRYSTALLIZED PRODUCTS IN CAST BILLET)

(INTERVAL BETWEEN STRIATIONS ON FRACTURE SURFACE)

FIG. 6A
FIG. 6B
(CRYSTAL GRAIN SIZE OF EXTRUDED PRODUCT)
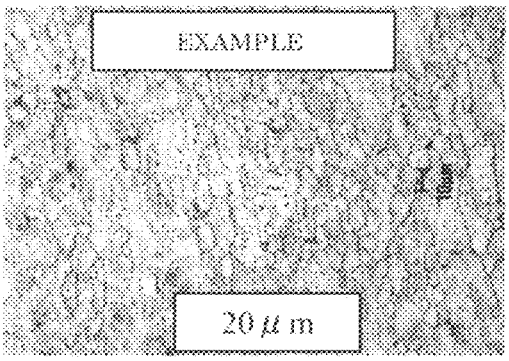
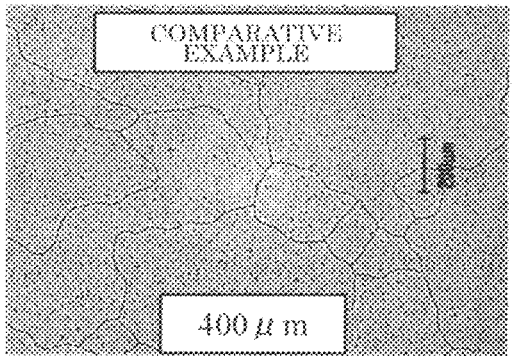

AL-MG-SI ALUMINUM ALLOY EXTRUDED PRODUCT EXHIBITING EXCELLENT FATIGUE STRENGTH AND IMPACT FRACTURE RESISTANCE

This application is a divisional of U.S. patent application Ser. No. 12/543,545 filed on Aug. 19, 2009 now abandoned. This application claims the benefit of Japanese Patent Application No. 2008-213384 filed on Aug. 21, 2008 and Japanese Patent Application No. 2009-135607 filed on Jun. 5, 2009. The disclosures of the above applications are hereby incorporated by reference in their entirety.

BACKGROUND

The present invention relates to an Al—Mg—Si aluminum alloy extruded product that exhibits high fatigue strength, excellent impact fracture resistance, and excellent formability.

In recent years, automotive components made of aluminum have been studied and used in practice in order to reduce the weight of automobiles to improve travel performance and reduce fuel consumption from the viewpoint of environment protection.

Since an aluminum alloy structural material used for automobiles or the like is repeatedly subjected to impact during travel, it is necessary to design the material taking account of the fatigue strength of the material.

Therefore, a high-strength material is used to provide fatigue strength. A component that is directly subjected to and absorbs impact during travel is also required to exhibit high impact fracture resistance.

However, high-strength aluminum alloys that have been proposed exhibit poor extrusion productivity so that the production cost increases.

When producing an aluminum structural material used for automotive underbody parts or the like, the product may require press working or bending depending on the shape of the product. When using a high-strength material, cracks or orange peeling occur on the surface of the material during press working or bending. The fatigue strength of the material decreases due to such surface defects. Therefore, the surface defects must be removed by a mechanical polishing step (e.g., buffing) so that the production cost increases.

JP-A-2005-82816 discloses an aluminum alloy forged material that exhibits high-temperature fatigue strength. However, the Al—Cu aluminum alloy disclosed in JP-A-2005-82816 is suitable for a forged material, but cannot be applied to an extruded product.

An object of several aspects of the invention is to provide an Al—Mg—Si aluminum alloy extruded product that exhibits high extrusion productivity, high fatigue strength, excellent impact fracture resistance, and excellent formability.

SUMMARY

According to one aspect of the invention, there is provided an aluminum alloy extruded product that exhibits excellent fatigue strength and impact fracture resistance, the aluminum alloy extruded product comprising 0.3 to 0.8 mass % of Mg, 0.5 to 1.2 mass % of Si, 0.3 mass % or more of excess Si with respect to the $Mg_2Si$ stoichiometric composition, 0.05 to 0.4 mass % of Cu, 0.2 to 0.4 mass % of Mn, 0.1 to 0.3 mass % of Cr, 0.2 mass % or less of Fe, 0.2 mass % or less of Zr, and 0.005 to 0.1 mass % of Ti, with the balance being aluminum and unavoidable impurities, the aluminum alloy extruded product having a fatigue strength of 140 MPa or more, a fatigue ratio of 0.45 or more, and an interval between striations on a fatigue fracture surface of 5.0 μm or less.

BRIEF DESCRIPTION OF THE DRAWINGS

FIG. 1 shows the compositions of aluminum alloys used for evaluation.

FIG. 2 shows evaluation results for billets or extruded products that differ in alloy composition.

FIG. 3 shows property values and the like of extruded products subjected to a solution treatment (immediately after extrusion).

FIGS. 6A and 6B show photographs used to evaluate a grain size.

DESCRIPTION OF EXEMPLARY EMBODIMENTS

Figure 4A:
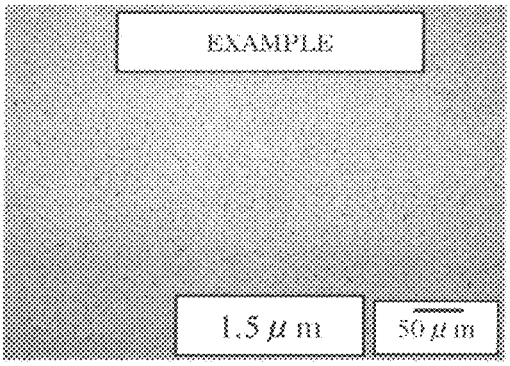
FIGS. 4A and 4B show photographs used to evaluate the length of crystallized products.

According to one embodiment of the invention, there is provided an aluminum alloy extruded product that exhibits excellent fatigue strength and impact fracture resistance, the aluminum alloy extruded product comprising 0.3 to 0.8 mass % of Mg, 0.5 to 1.2 mass % of Si, 0.3 mass % or more of excess Si with respect to the $Mg_2Si$ stoichiometric composition, 0.05 to 0.4 mass % of Cu, 0.2 to 0.4 mass % of Mn, 0.1 to 0.3 mass % of Cr, 0.2 mass % or less of Fe, 0.2 mass % or less of Zr, and 0.005 to 0.1 mass % of Ti, with the balance being aluminum and unavoidable impurities, the aluminum alloy extruded product having a fatigue strength of 140 MPa or more, a fatigue ratio of 0.45 or more, and an interval between striations on a fatigue fracture surface of 5.0 μm or less.

The aluminum alloy extruded product according to one aspect of the invention is characterized in that the Mg content and the Si content are set so that the aluminum alloy extruded product includes 0.5 to 1.5 mass % of $Mg_2Si$ and 0.3 mass % or more of excess Si with respect to the $Mg_2Si$ stoichiometric composition.

The term "fatigue ratio" refers to the ratio of the rotating fatigue strength σw ($10^7$ times) to the tensile strength $\sigma_B$. The term "striation" refers to a line or a groove that forms a stripy pattern that occurs on a metal fatigue fracture surface due to slip plane separation.

It is effective to reduce the maximum length of Al—Mg—Si crystallized products to 10.0 μm or less in order to adjust the fatigue ratio to 0.45 or more and the average interval between striations to 5.0 μm or less.

The maximum length of Al—Mg—Si crystallized products of an aluminum alloy ingot may be reduced to 10.0 μm or less by casting the ingot (cylindrical billet) at a casting speed of 80 mm/min or more (cooling rate: 15° C./sec or more).

Since such an aluminum alloy ingot exhibits excellent extrudability, the forming load (i.e., the stem pressure of an extrusion press machine) during extrusion can be set to be 0.9 or less with respect to an alloy defined in JIS 6061.

When producing the extruded product, it is preferable to reduce the average grain size of the extruded product to 50 μm or less.

The extruded product according to the invention exhibits excellent press workability and bendability. It is preferable that the extruded product subjected to a solution treatment have an r-value (Lankford value) of 0.7 or more or an n-value (work hardening exponent) of 0.23 or more or does not produce cracks on its surface when subjected to a bending test that causes an outer surface elongation of 60% or more.

The content range of each component is described below.

Mg and Si

Si is necessary to maintain the strength of the aluminum alloy. However, the extrudability of the aluminum alloy is impaired if the Si content is too high.

Mg is necessary to maintain the strength of the aluminum alloy. However, the extrudability of the aluminum alloy is impaired if the Mg content is too high.

Therefore, the Mg content is set to 0.3 to 0.8 mass %, and the Si content is set to 0.5 to 1.2 mass %.

It is preferable to control the $Mg_2Si$ content to 0.5 to 1.5 mass % and the content of excess Si with respect to the $Mg_2Si$ stoichiometric composition to 0.3 mass % or more taking account of precipitation hardening due to $Mg_2Si$.

The Si content and the Mg content significantly affect the mechanical properties (e.g., tensile strength and fatigue strength) of the aluminum alloy. When a fatigue strength of 160 MPa or more is required, it is preferable that the Mg content be 0.45 to 0.8 mass %, the Si content be 0.7 to 1.2 mass %, the $Mg_2Si$ content be 0.7 to 1.5 mass %, and the excess Si content be 0.45 mass % or more.

When a fatigue strength of 180 MPa or more is required, it is preferable that the Mg content be 0.55 to 0.8 mass %, the Si content be 0.9 to 1.2 mass %, the $Mg_2Si$ content be 0.9 to 1.5 mass %, and the excess Si content be 0.6 mass % or more.

Cu

Cu improves the strength and the elongation of the aluminum alloy. However, the corrosion resistance and the extrusion productivity of the aluminum alloy deteriorate if the Cu content is too high. Therefore, the Cu content is set to 0.05 to 0.4 mass %, and preferably 0.2 to 0.4 mass %.

Fe

Fe forms a crystallized product with Si if the Fe content is too high. As a result, the strength and the corrosion resistance of the aluminum alloy decrease. Therefore, the Fe content is set to 0.20 mass % or less, preferably 0.10 mass % or less, and more preferably 0.05 mass % or less.

Mn

Mn suppresses recrystallization to refine the grains of the aluminum alloy, and stabilizes the fiber texture of the aluminum alloy to improve impact resistance. However, the quench sensitivity of the aluminum alloy increases if the Mn content is too high so that the strength of the aluminum alloy decreases. Therefore, the Mn content is set to 0.2 to 0.4 mass %, and preferably 0.3 to 0.4 mass %.

Cr

Cr suppresses recrystallization to refine the grains of the aluminum alloy, and stabilizes the fiber texture of the aluminum alloy to improve impact resistance. However, the quench sensitivity of the aluminum alloy increases if the Cr content is too high so that the strength of the aluminum alloy decreases. Therefore, the Cr content is set to 0.1 to 0.3 mass %, and preferably 0.15 to 0.25 mass %.

Zr

Zr suppresses recrystallization to refine the grains of the aluminum alloy, and stabilizes the fiber texture of the aluminum alloy to improve impact resistance. However, the quench sensitivity of the aluminum alloy increases if the Zr content is too high so that the strength of the aluminum alloy decreases. Therefore, the Zr content is set to 0.20 mass % or less, and preferably 0.10 mass % or less.

Ti

Ti refines the grains of the aluminum alloy during casting. However, a number of coarse intermetallic compounds are produced if the Ti content is too high so that the strength of the aluminum alloy decreases. Therefore, the Ti content is set to 0.005 to 0.1 mass %.

Unavoidable Impurities

Unavoidable impurities do not affect the properties of the aluminum alloy if the content of each impurity element is 0.05 mass % or less and the total content of impurity elements is 0.15 mass % or less.

Production Method (1) A cylindrical billet is cast at a casting speed of 70 mm/min or more, and preferably 80 mm/min or more (cooling rate: 15° C./sec) to control the form of crystallized products.

(2) The billet is homogenized at 565 to 595° C. for four hours or more.

(3) The billet heating temperature during extrusion is set at 470° C. or more so that the aluminum alloy extruded product is quenched. The upper limit of the billet heating temperature during extrusion is about 580° C. or less taking account of local melting of the billet.

The cooling rate after extrusion is set at 500° C./min or more so that the aluminum alloy extruded product is quenched.

An artificial aging treatment is performed after quenching at 175 to 195° C. for 1 to 24 hours (under-aging conditions).

According to one aspect of the invention, since the Al—Mg—Si aluminum alloy has the composition defined in claim 1 and has an average interval between striations of 5.0 μm or less, high fatigue strength and excellent impact fracture resistance can be obtained. Therefore, the aluminum alloy can be widely applied to a structural material (e.g., automotive component) that is repeatedly subjected to impact during travel.

Since the extruded product has an r-value and an n-value equal to or larger than given values, the extruded product exhibits excellent press workability and bendability.

Examples according to the invention are described below based on comparison with comparative examples.

A molten aluminum alloy containing components shown in FIG. 1 (balance: aluminum) was prepared, and was cast at a casting speed shown in FIG. 1 to obtain a cylindrical billet.

The billet was extruded into a round bar extruded product (diameter: 26 mm) using an extruder. The extruded product was water-cooled immediately after extrusion at a cooling rate of 500° C./min or more (die-end quenching), followed by artificial aging. FIG. 2 shows the property evaluation results.

FIG. 3 shows the evaluation results of the extruded product immediately after extrusion (before artificial aging).

The properties of the extruded product were evaluated under the following conditions.

Length of Crystallized Product

A specimen prepared from the center of the billet was etched (0.5% HF). The metal structure was observed using an optical microscope at a magnification of 1000 (measurement area: 0.166 $mm^2$, the maximum length of crystallized products was determined by image processing based on ten areas).

Striation

The metal structure at the center of the fracture surface of the extruded product that had been subjected to artificial aging and a rotating bending fatigue test was observed using a scanning electron microscope at a magnification of 200 or 2000. In this embodiment, the number of striations was measured at intervals of 10 mm to calculate the average interval between striations.

Fatigue Properties

A JIS No. 1 (1-8) specimen (for rotating bending fatigue test) was prepared from the extruded product subjected to artificial aging in accordance with JIS Z 2274. The specimen was subjected to a fatigue test using an Ono-type rotating bending fatigue tester conforming to the JIS standard.

$$\text{Fatigue ratio}=\sigma_w(10^7 \text{ fatigue strength})/\sigma_B(\text{tensile strength})$$

Tensile Properties

A JIS No. 4 tensile test specimen was prepared from the extruded product in accordance with JIS Z 2241. The specimen was subjected to a tensile test using a tensile tester conforming to the JIS standard.

FIG. 2 shows the measurement results of the extruded product subjected to artificial aging, and FIG. 3 shows the measurement results of the extruded product before artificial aging.

Impact Resistance

A JIS V-notch No. 4 specimen was prepared from the extruded product subjected to artificial aging in accordance with JIS Z 2242. The specimen was subjected to a Charpy impact test using a Charpy impact tester conforming to the JIS standard.

Grain Size

A test material was minor-polished and etched (3% NaOH, 40° C.×3 min). The metal structure of the test material was then observed using an optical microscope at a magnification of 50 or 400.

Extrudability

The stem pressure of a press machine during extrusion was evaluated as extrudability (JIS 6061 alloy=1).

Bendability and Surface Properties

Figure 7A:
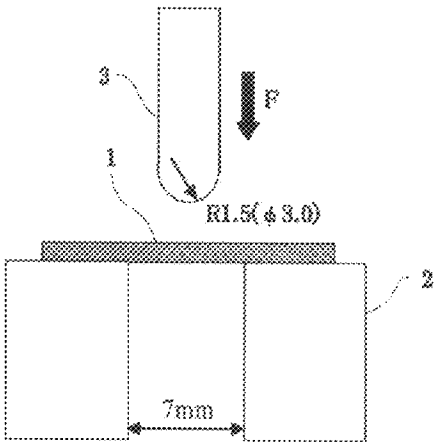
FIGS. 7A to 7D show an example of a bending test (evaluation method) conducted on an extruded product and evaluation results.

Bendability and surface properties shown in FIG. 3 were evaluated as follows. Specifically, a specimen (20×150 mm) was prepared from the extruded product (test material) that had been water-cooled immediately after extrusion and subjected to a solution treatment. As shown in FIG. 7A, a test material 1 was placed on a lower jig 2, and a load was applied to the test material 1 from above using a punch 3 (R: 1.5 mm).

Figure 7B:
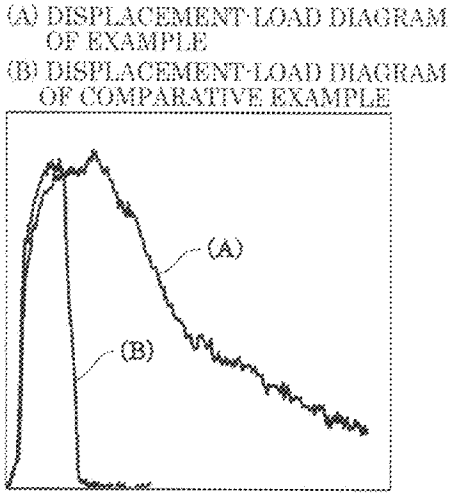
Figure 7C:
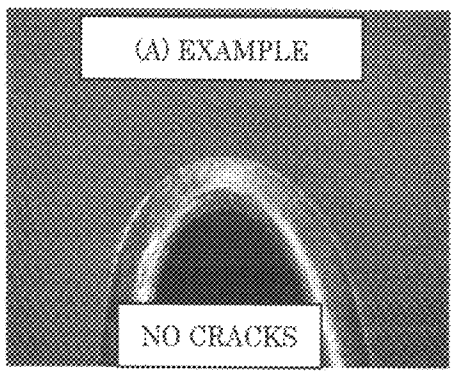
Figure 7D:
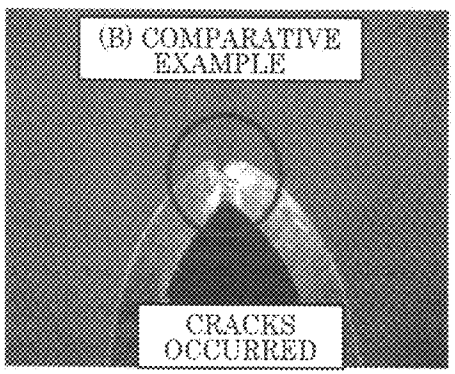

FIG. 7B shows a displacement-load diagram during the evaluation. FIGS. 7C and 7D show examples of evaluation of the presence or absence of cracks in the bent portion.

In FIGS. 7B to 7D, (A) indicates an example of an alloy of the example according to the invention (example extruded product), and (B) indicates an example of an alloy of the comparative example (comparative extruded product).

As shown in FIG. 7B, cracks did not occur in the extruded product (A) of the example according to the invention and showed a load displacement with toughness. On the other hand, cracks occurred in the extruded product (B) of the comparative example so that the load suddenly decreased.

Figure 8A:
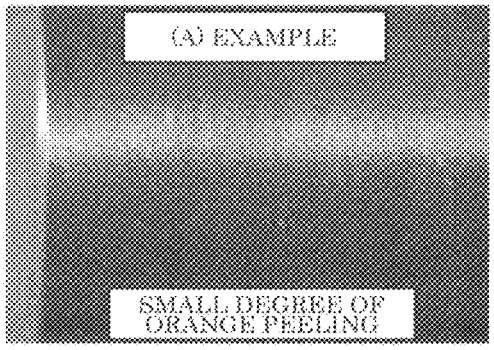
FIGS. 8A and 8B show photographs used to evaluate orange peeling on a bent surface of an extruded product.
Figure 8B:
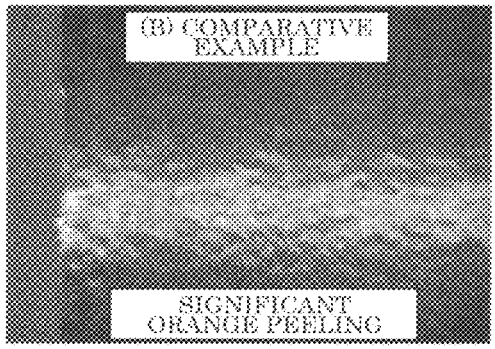

FIGS. 8A and 8B show photographs showing the surface properties of the extruded product (A) of the example according to the invention and the extruded product (B) of the comparative example after the bending test.

A case where only a small degree of orange peeling that did not affect the fatigue strength was observed was evaluated as "Good", and a case where significant orange peeling was observed was evaluated as "Bad".

Note that the bent surface is normally elongated by 67% under the above bending test conditions.

N-Value

A JIS No. 4 tensile test specimen was prepared from the extruded product that had been water-cooled immediately after extrusion and subjected to a solution treatment in accordance with JIS Z 2241. The specimen was subjected to a tensile test using a tensile tester conforming to the JIS standard. The n-value (i.e., an exponent n when a true stress-true strain curve determined by a load-elongation curve is approximately indicated by $\sigma=F\epsilon^n$) was calculated from the slope when the true stress-true strain value was plotted into the double logarithmic graph.

The n-value is referred to as a work hardening exponent. A large n-value indicates excellent formability.

R-Value

A JIS No. 4 tensile test specimen was prepared from the extruded product that had been water-cooled immediately after extrusion and subjected to a solution treatment in accordance with JIS Z 2241. The specimen was subjected to a tensile test using a tensile tester conforming to the JIS standard. The ratio of the true strain in the widthwise direction to the true strain in the thickness direction of the specimen during the tensile test was calculated as the r-value (Lankford value).

Specifically, the width $W_0$ and the thickness $T_0$ of the specimen before the tensile test and the width $W_1$ and the thickness $T_1$ of the specimen after the tensile test were measured, and the r-value was calculated by the expression "$r=(\ln W_0/W_1)/(\ln T_0/T_1)$".

A cooling rate of 15° C./sec or more was obtained for alloys No. 1 to No. 5 (examples) shown in FIGS. 1 to 3 by setting the casting speed at 80 mm/min or more.

Figure 4B:
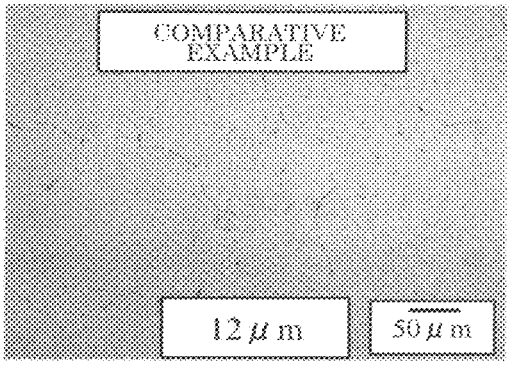

A specimen was prepared from the center of the cylindrical billet, and the metal structure was observed using an optical microscope after etching the specimen. FIGS. 4A and 4B show photographs of the metal structure.

The maximum length of Al—Fe—Si crystallized products (measured for ten areas, 0.166 $mm^2$) of an alloy No. 2 (example) shown in FIG. 4A was 1.5 μm (i.e., 10 μm or less). On the other hand, the maximum length of Al—Fe—Si crystallized products of an alloy No. 13 (comparative example) shown in FIG. 4B was 12 μm.

Figures 5A, 5B:
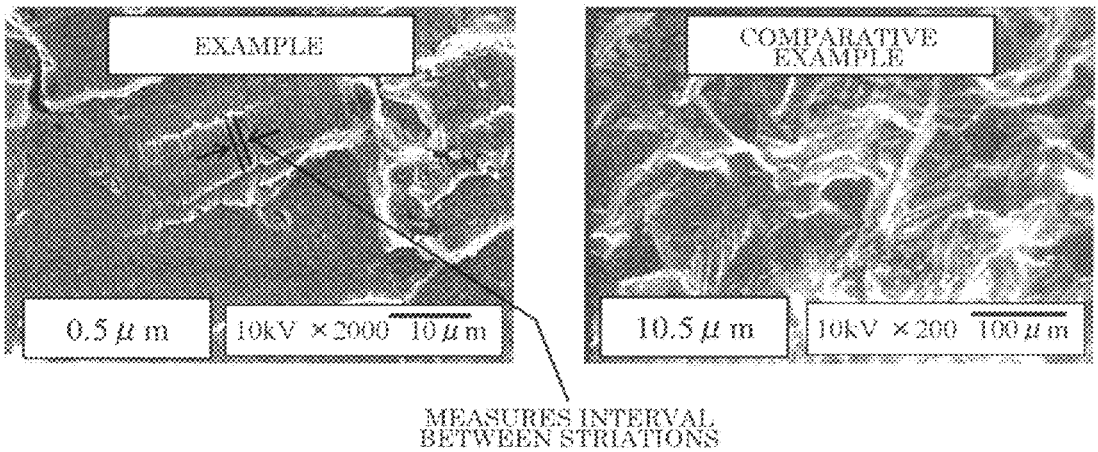
FIGS. 5A and 5B show photographs used to evaluate striation.

FIGS. 5A and 5B show photographs of the center of the fracture surface of the extruded product that had been subjected to artificial aging and the rotating bending fatigue test ($10^7$ times).

The average interval between striations (measured at intervals of 10 mm) of the alloy No. 2 (example) shown in FIG. 5A was 0.5 μm (i.e., 5.0 μm or less). On the other hand, the average interval between striations of an alloy No. 12 (comparative example) shown in FIG. 5B was 10.5 μm.

FIGS. 6A and 6B show photographs of the metal structure of the extruded product.

The alloys of the examples according to the invention had an average grain size of 40 μm or less (i.e., 50 μm or less (target value)) (see FIGS. 2 and 6A). On the other hand, alloys No. 11 and No. 12 (comparative examples) had an average grain size as large as 400 to 800 μm (see FIGS. 2 and 6B).

It is considered that the alloy No. 13 (comparative example) had an average grain size of 40 μm due to the effects of grain refinement components (e.g., Mn and Cr). However, the length of crystallized products in the billet was as large as 12 μm (see FIG. 2). As a result, the fatigue ratio (target value: 0.45 or more) and the impact value (target value: 60 $J/cm^2$) did not reach the target values.

An alloy No. 10 (comparative example) that satisfied the target values shown in FIG. 2 had an $Mg_2Si$ content of 1.53 mass % (i.e., outside the range of 0.5 to 1.5 mass %) and an excess Si content ("exSi" in FIG. 1) of 0.06 mass % (i.e., 0.3 mass % or less). As a result, the alloy No. 10 exhibited an extrudability (indicated by the forming load during extrusion) of 1.0 (target value: 0.9 or less) (see FIG. 3).

In the examples according to the invention, a fatigue strength of 140 MPa or more and an impact value of 60 J/cm$^2$ or more were set as target values on the assumption that the extruded product is applied to a structural material for which high fatigue strength and excellent impact fracture resistance are required.

As is clear from the results shown in FIGS. 2 and 3, when the length of crystallized products in the billet was 10.0 μm or less and the interval between striations on the fatigue fracture surface was 5.0 μm or less, the forming load during extrusion was 0.9 or less with respect to an alloy defined in JIS 6061. When the grain size of the extruded product was 50 μm or less, the extruded product exhibited high fatigue strength and had a high Charpy impact value.

In Examples 2-1 and 2-2 in which the Mg content was 0.55 to 0.8 mass %, the Si content was 0.9 to 1.2 mass %, the $Mg_2Si$ content was 0.9 to 1.5 mass %, and the excess Si content was 0.6 mass % or more, a fatigue strength of 180 MPa or more and a proof stress of 370 MPa (i.e., higher than those achieved in Examples 1 to 5) were obtained.

In Examples 2-1 and 2-2, although the Si content was set to be close to the upper limit, the interval between striations was as small as 1.0 μm and the fatigue ratio was as high as 0.46 as a result of setting the excess Si content to 0.6 mass % or more. Moreover, a high impact value of 70 J/cm$^2$ or more (excellent impact fracture resistance) was obtained.

FIG. 3 shows the formability evaluation results of the extruded products of the examples according to the invention and the extruded products of the comparative examples.

When producing automotive underbody parts or the like, an aluminum alloy that has been subjected to a solution treatment is generally subjected to press working or bending before subjecting the aluminum alloy to artificial aging. Therefore, the target n-value and the target r-value shown in FIG. 3 that indicate formability are set to 0.23 or more and 0.7 or more, respectively.

The aluminum alloy extruded products of the examples according to the invention achieved all of the target values, and did not produce cracks during the 60% elongation bending test.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A method of producing an aluminum alloy extruded product comprising:

preparing a molten aluminum alloy consisting of 0.3 to 0.8 mass % of Mg, 0.5 to 1.2 mass % of Si, 0.3 mass % or more of excess Si with respect to the $Mg_2Si$ stoichiometric composition, 0.05 to 0.4 mass % of Cu, 0.2 to 0.4 mass % of Mn, 0.1 to 0.3 mass % of Cr, 0.2 mass % or less of Fe, 0.2 mass % or less of Zr, and 0.005 to 0.1 mass % of Ti, with the balance being aluminum and unavoidable impurities;

casting the molten aluminum alloy into a billet at a casting speed of 80 mm/min or more and at a cooling rate of 15° C./sec or more;

extruding the billet into an aluminum alloy extruded product;

water cooling the aluminum alloy extruded product immediately after the extrusion at a cooling rate of 500° C./min or more; and artificial aging the aluminum alloy extruded product, thereby producing the aluminum alloy extruded product having a fatigue strength of 140 MPa or more, a fatigue ratio of 0.45 or more, an interval between striations on a fatigue fracture surface of 5.0 μm or less and a maximum length of Al—Fe—Si crystallized products of 10 μm or less.

2. The method of producing an aluminum alloy extruded product as defined in claim 1, the aluminum alloy extruded product having an average grain size of 50 μm or less.

3. The method of producing an aluminum alloy extruded product as defined in claim 1, a forming load during the extrusion of the aluminum alloy extruded product being 0.9 or less with respect to an alloy defined in JIS 6061.

4. The method of producing an aluminum alloy extruded product as defined in claim 1, the aluminum alloy extruded product that has been subjected to a solution treatment having a Lankford value of 0.7 or more.

5. The method of producing an aluminum alloy extruded product as defined in claim 1, the aluminum alloy extruded product that has been subjected to a solution treatment having a work hardening exponent of 0.23 or more.

6. The method of producing an aluminum alloy extruded product as defined in claim 1, the aluminum alloy extruded product that has been subjected to a solution treatment not producing cracks on its surface when subjected to a bending test that causes an outer surface elongation of 60% or more.

* * * * *